United States Patent [19]

Patty

[11] 4,042,919

[45] Aug. 16, 1977

[54] ILLUMINATED SIGN AND HIGH INTENSITY WARNING DEVICE

[76] Inventor: Richard L. Patty, Box 56, New Haven, Ind. 46774

[21] Appl. No.: 630,443

[22] Filed: Nov. 10, 1975

[51] Int. Cl.[2] ..... G08B 5/00; H05B 41/00

[52] U.S. Cl. ..... 340/321; 40/129 A; 40/130 B; 240/10.63; 340/105; 340/331

[58] Field of Search ..... 340/321, 331, 84, 105, 340/107; 40/129 R, 129 A, 130 R, 130 B; 240/10.6 R, 22, 10.63, 38

[56] References Cited

U.S. PATENT DOCUMENTS

| | | | |
|---|---|---|---|
| 1,764,426 | 6/1930 | Townsend | 340/84 |
| 1,848,951 | 3/1932 | Haynes | 40/129 A |
| 2,035,841 | 3/1936 | Signor | 240/22 |
| 2,717,336 | 9/1955 | Craddock | 340/105 |
| 2,838,744 | 6/1958 | De Wald | 340/84 |
| 3,142,038 | 7/1964 | Jackson | 340/105 |
| 3,279,110 | 10/1966 | Lelicoff | 340/321 |
| 3,383,675 | 5/1968 | Allardice et al. | 240/10.63 |
| 3,500,378 | 3/1970 | Pickering et al. | 340/331 |
| 3,519,984 | 7/1970 | Zychal | 340/331 |
| 3,810,091 | 5/1974 | Hoover | 340/321 |
| 3,821,860 | 7/1974 | Patty | 40/129 A |

*Primary Examiner*—John W. Caldwell
*Assistant Examiner*—James J. Groody
*Attorney, Agent, or Firm*—Gust, Irish, Jeffers & Rickert

[57] ABSTRACT

A hand-held illuminated sign has a one piece frame comprising a perimetral wall and perimetral flanges extending inwardly from the wall edges. Translucent sign panels are fastened to the flanges. An elongate lighting member has a bulbous housing at one end that threadedly receives an annular cap. The frame wall has a portion defining an opening for tightly receiving the housing. The cap is threaded on the housing and tightly against the wall portion to hold the frame and lighting member in unified engagement. A strobe light, in combination with the sign illuminating light, is secured to the wall to emit intermittent, high intensity light energy to signal the presence of the sign bearer from distances greater than those at which the sign illumination is perceivable.

5 Claims, 8 Drawing Figures

ILLUMINATED SIGN AND HIGH INTENSITY WARNING DEVICE

BACKGROUND OF THE INVENTION

1. Field of the Invention

This invention is in the field of illuminated signal signs and more particularly, to those signs that are hand-held and used for traffic control.

2. Description of the Prior Art

Illuminated hand-held signal signs such as that illustrated in my U.S. Pat. No. 3,821,860 are known to the art. These signs are designed to be light in weight, simple and durable of construction and low in cost. It is desirable to use standard, readily available, sign illuminating components such as a common flashlight for sign illumination and also to serve as a sign handle. However, problems arise in providing a design which can make full use of the light illuminating properties and also securely hold the light to the sign frame in a sturdy, durable, simple, unified engagement. Further, such devices have lacked adequate intensity to signal presence of the sign bearer from a distance greater than that at which the sign illumination is preceivable.

SUMMARY OF THE INVENTION

A perimetral frame wall and perimetral flanges extending inwardly from the wall edges. Translucent sign panels carrying a sign word message are fastened to the flanges. An elongate light member having a bulbous housing at the light emitting end houses a light bulb and bulb reflector. The open end of the housing has a recessed circular step. A wall portion has an opening to tightly receive the threaded end and an annular cap threadedly engages the housing end and is tightened fast against the wall portion surface to hold the frame and light member in unified engagement. In addition, a high intensity strobe light is wall connected and provides a long range luminant signal to warn oncoming traffic of the sign bearer presence prior to the perceptibility of the sign illumination.

It is therefore an object of this invention to provide a sturdy, durable, hand-held illuminated sign.

A further object is to provide in the sign of the foregoing object a high intensity visual warning signal in addition to that signal provided by the sign illumination.

The above-mentioned and other features and objects of the invention and the manner of attaining them will become more apparent and the invention itself will be best understood by reference to the following description of an embodiment of the invention taken in conjunction with the accompanying drawings.

DESCRIPTION OF A PREFERRED EMBODIMENT

Figure 1:
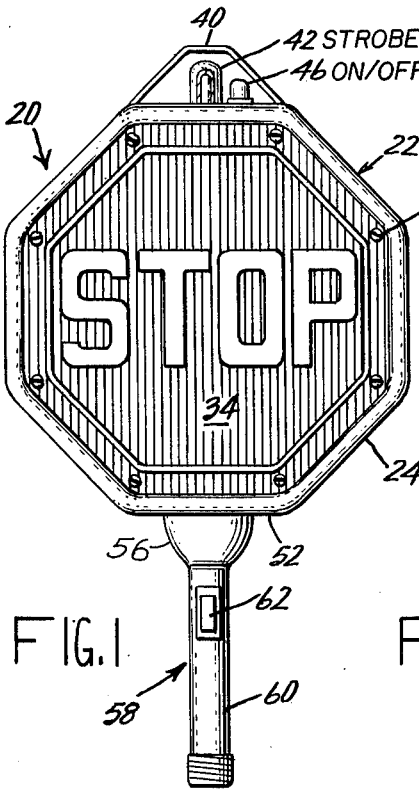
FIG. 1 is a front view of a preferred embodiment of this invention.
Figure 2:
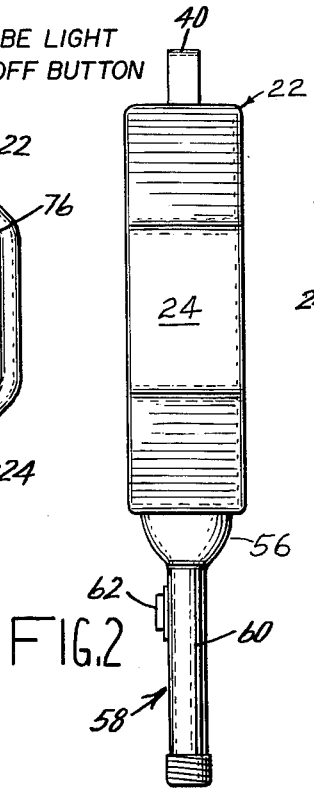
FIG. 2 is a side view of the embodiment of FIG. 1.
Figure 3:
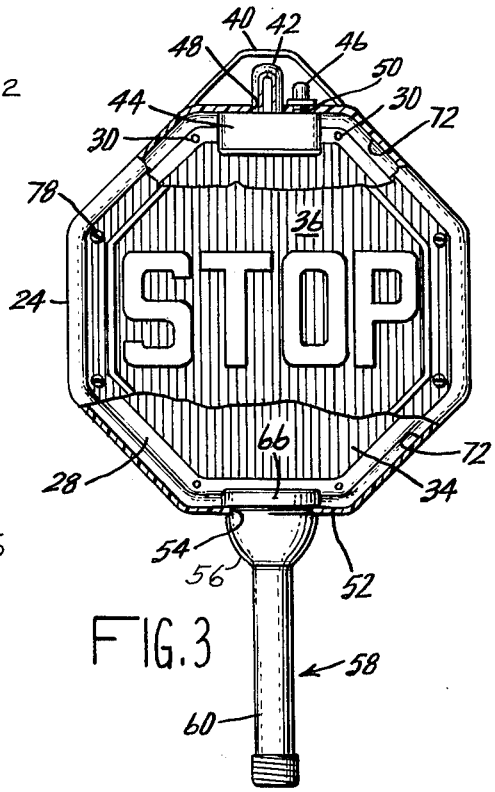
FIG. 3 is a rear view, partially broken away, of the embodiment of FIG. 1.
Figure 4:
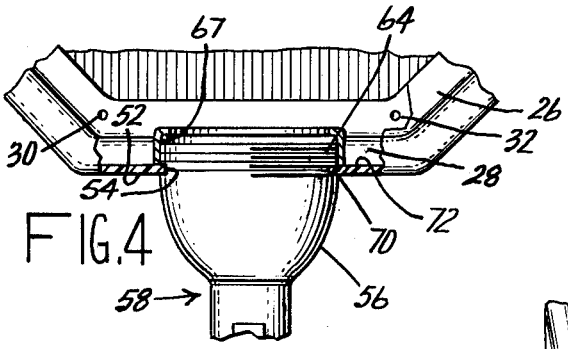
FIG. 4 is a partial, broken away, view of the connection between the sign illuminating member and the sign frame.

Referring to the drawing, illuminated sign 20 has an octogonal frame 22 composed of a perimetral wall 24 and flanges 26 and 28 which extend inwardly from opposite edges of wall 24. Screw holes 30 and 32 are provided in inwardly stepped portions of flanges 26 and 28, respectively, for fastening sign panels 34 and 36. Frame 22 is preferably made of a molded semi rigid plastic material and panels 34 and 36 are made of a colored, translucent light diffusing material and carry thereon a sign message. The flanges 26 and 28 are each stepped inwardly to provide flange portions against which the respective panels 34 and 36 are abutted. The outer surfaces of panels 34 and 36 are thus positioned to be substantially flush with outer surface of the outermost portions of flanges 26 and 28, respectively. Also, in one embodiment, with the panels of the illustrated octogonal shape, the inset flange 26, 28 portions are shaped complementary such that the panels 34, 36 are positively located on the frame 22.

Arch 40 is mounted to the top side of frame 22 and provides a protective guard for a strobe light 42 extending from a casing 44 mounted to the underside of wall 24. An "on-off" button 46 also extends from casing 44. Opening 48 is provided in wall 24 to receive light 42 and opening 50 receives button 46. Casing 44 is adhered to the inner side 24 by an adhesive or other suitable fastening means.

Lowermost segment 52 of wall 44 has round opening 54 for receiving bulbous housing 56 of a conventional flashlight 58 having elongate handle 60 and switch 62. Housing 56 is threaded at 64 to threadedly receive annular cap 66 having perimetral rim 67 which is adapted for holding a flashlight lense to housing 56. An annular step 70 is formed in housing 56 for engagement with cap 66 when it is fully threaded onto housing 56.

Flashlight 58 is inserted from the inside of frame 22 through opening 54 until the annular step 70 is forced or snapped therethrough positioning the step 70 contiguous to the outside of wall 52. The annular step 70 is slightly larger in diameter than opening 54. Cap 66 is then threaded onto threads 64 until the edge rim 67 seats firmly against wall portion 52 in which opening 54 is formed. This holds flashlight 58 securely to wall portion 52, the wall 52 being clamped between annular step 70 and rim 67, thus holding flashlight 58 and frame 22 in unified engagement by means of a very simple, inexpensive, rigid coupling. For those flashlights which do not have a step 70, threads 64 are threadedly rotated into opening 54 and cap 66 is then turned onto threads 64 until the edge of rim 67 engages wall section 52. The inner surface of wall 24 may be provided with a reflective material 72, such as a fluorescent paint, to enhance the lighting of the sign panels 34 and 36 upon actuation of flashlight 58.

Panels 34 and 36 are then placed against flanges 26 and 28, respectively and screws 76 and 78 are screwed into holes 30 and 32, respectively, to firmly attach panels 34 and 36 to frame 22.

Figure 7:
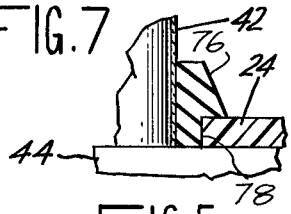
FIG. 7 is a partial view in section of an alternative mounting for the strobe bulb in the sign frame.
Figure 5:
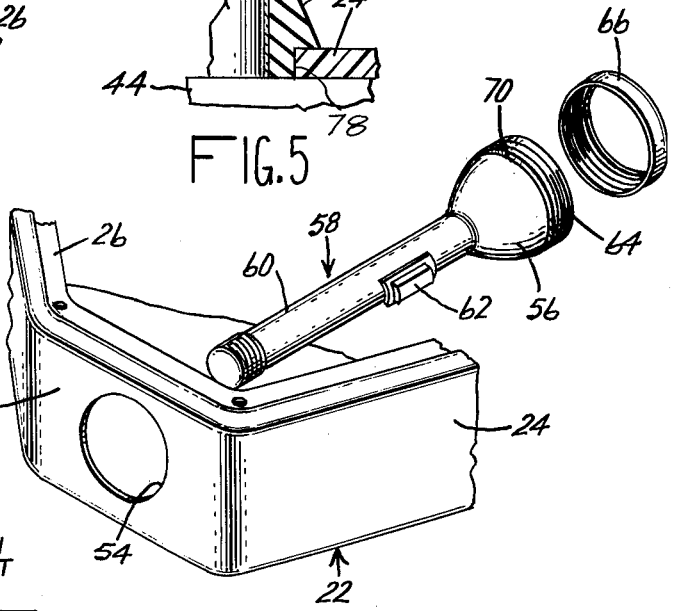
FIG. 5 is a partial view of the sign frame and illuminating member prior to assembly.
Figure 8:
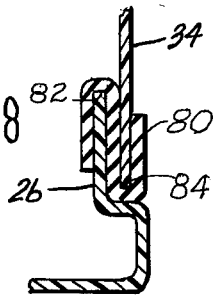
FIG. 8 is a partial view in section of an alternative mode of mounting the sign panel in the sign frame.

Referring to FIG. 7, bulb 42 has fitted around the base thereof an annular rubber grommet 76 which has a groove 78 for receiving the edge of wall 24 of frame 22. Grommet 76 serves to resiliently support bulb 42 and to provide a seal around the base thereof. Referring to FIG. 8, a rubber annular seal 80, which is a reverse S shape in cross section, has a first annular groove 82 for receiving flange 26 and a second annular groove 84 for receiving panel 34. Seal 80 provides a resilient supportive mounting for panel 34 and also inhibits moisture penetration at the recessed step of flange 26.

Casing 44 houses the battery and circuitry for energizing strobe light 42. The circuit diagram of the components housed by casing 44 is shown in FIG. 6.

Figure 6:
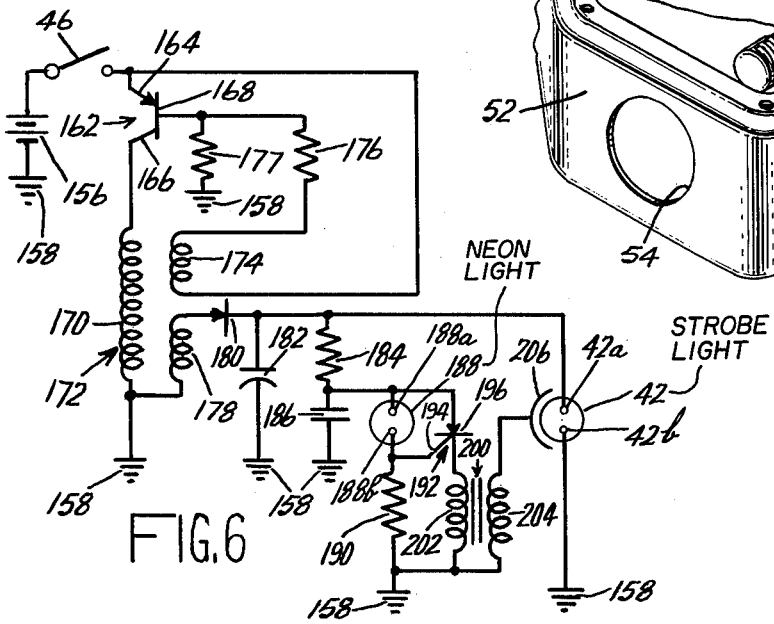
FIG. 6 is a schematic view of the strobe light circuitry for the embodiment of FIG. 1.

The circuitry for energizing strobe 52, which is entirely self-contained in housing 44, is shown in the circuit diagram of FIG. 6. A battery 156 for supplying between 6 to 9 volts DC and commercially available, is connected to ground 158 at is negative terminal and to switch 42 at its positive terminal. Switch 46 is connected to the emitter 164 of transistor 62. The collector 166 of transistor 162 is connected to one end of primary 170 of transformer 172, the other end of primary 170 being connected to ground 158. Secondary winding 174 of transformer 172 has one terminal connected to one end of current limiting resistor 176 which is connected at its other end to base 168 of transistor 162 and to bias resistor 177 which is connected between base 168 and ground 158. The other terminal of secondary 174 is connected to switch 46.

Secondary winding 178 is connected at one terminal to ground 158 and the other terminal to anode of diode 180, the cathode of which is connected to one plate of capacitor 182, one terminal of resistor 184 and strobe light 42, the other terminal of resistor 184 is connected to one plate of capacitor 186, which has its other plate connected to ground 158 and to one terminal of neon element 188, having its other terminal connected to resistor 190 and to the control electrode 194 of silicon-controlled rectifier 192. The anode 196 of rectifier 192 is connected to the one terminal of neon bulb 188 and the cathode 198 of rectifier 192 is connected to one terminal of primary 202 of transformer 200, the other terminal of primary 202 being connected to ground 158. Neon bulb 188 contains neon gas which conducts when the voltage between its electrodes 188*a* and 188*b* reaches approximately 90 volts.

Secondary 204 of transformer 200 has one terminal connected to the trigger electrode 206 of flash tube or strobe light 42 and the other terminal of secondary 204 is connected to ground 158. In one operating embodiment, the voltage across primary 202 is 400 volts while the voltage across secondary 204 is 4 kilovolts. Tube 42 is a U-shaped tube filled with a rare gas and has anode 42*a* and cold cathode 42*b*.

In the operation of the circuit of FIG. 6, closure of switch 46 causes transistor 162 to conduct since the emitter-base junction is forward biased. A voltage of approximately 12 volts is placed across primary 170 of transformer 172 and a voltage of approximately three volts is developed across secondary 174 causing transistor 162 to oscillate. The voltage developed across secondary 178 is rectified by diode 180, charging capacitor 182. As capacitor 182 becomes charged, the frequency of oscillation of transistor 162 increases, increasing the charge on capacitor 182. At the same time, the charge on capacitor 186 is being increased; when the voltage across capacitor 186 reaches approximately 90 volts, neon tube 188 fires triggering control electrode 194 of rectifier 192 causing rectifier 192 to conduct, placing approximately 400 volts across primary 202 of transformer 200. The voltage across secondary winding 204 is approximately 4 kilovolts which is applied to trigger electrode 206 of flash tube 42, triggering tube 42 "on". The charge on capacitor 182 is then "dumped" through tube 42 causing a brilliant flash which lasts until capacitor 182 is discharged. Tube 42 then is turned "off" and capacitor 182 again begins to charge repeating the cycle. With the component values used in a preferred embodiment, tube 42 flashes once every 2 seconds.

The strobe light 42 emits a high intensity intermittent light visible to oncoming traffic, when the device of this invention is used as a hand-held traffic stop signal, for a distance considerably greater than that distance at which the sign illumination from flashlight 58 is perceptible. This provides added protection for the sign user, which protection is of considerable importance during dark or inclement weather. The strobe light 42 "forewarns" the driver thereby offering substantially greater protection to the person holding the sign.

While there have been described above the principles of this invention in connection with specific apparatus, it is to be clearly understood that this description is made only by way of example and not as a limitation to the scope of the invention.

What is claimed is:

1. An illuminated sign comprising:

a frame having a perimetral wall to define a frame opening;

a perimetral frame flange formed on each wall edge and extending inwardly from the wall;

a first panel connected at its circumferential edge to one perimetral flange and a second panel connected at its circumferential edge to the other perimetral flange, at least one of said panels being of a light transmissive material;

an elongate lighting device having at one end thereof a bulbous housing having an open end; a light emitting element; said housing supporting said light emitting element and reflector means directing the light emission from said element;

an annular cap having a perimetral rim depending from the outer circumference thereof; said rim having an edge defining an opening for receiving the open end of said housing in close-fitting relation; a wall portion of said frame having a wall opening therein for receiving said open end in close-fitting relation;

said rim and said housing being in threadedly removable and adjustable engagement; said cap being threadedly tightened against said wall portion;

an annular wall receiving step being axially displaced from said housing open end; said step receiving and supporting said wall portion adjacent said wall opening and said wall portion adjacent said wall opening being firmly clamped between said step and said rim edge when said rim is threadedly tightened on said housing.

2. Apparatus according to claim 1 including a self-contained strobe lighting means fixedly supported relative said frame for emitting intermittent high intensity light energy thereby providing a distance perceptible signal.

3. Apparatus according to claim 2 wherein said frame wall and perimetral flanges are a one-piece molding.

4. Apparatus according to claim 3 in which said flanges are inwardly stepped to provide a recess for receiving said panels, respectively; said recesses having shapes complementary to those of the respective panels; the outer surfaces of said panels being substantially flush with said wall edges.

5. Apparatus according to claim 4 including a resilient annular seal between each of the sign panels and their respective frame flanges; said annular seals each having a reverse S cross section; each of said seals providing a first groove for receiving said flange and a second oppositely facing groove for receiving said sign panel.

* * * * *